United States Patent [19]

Capuano

[11] 4,411,147

[45] Oct. 25, 1983

[54] ROLLING DIES AND METHOD OF FORMING THE SAME

[75] Inventor: Terry D. Capuano, Hinckley, Ohio

[73] Assignee: Russell Burdsall & Ward Corporation, Mentor, Ohio

[21] Appl. No.: 292,256

[22] Filed: Aug. 12, 1981

[51] Int. Cl.[3] ..... B21H 3/06

[52] U.S. Cl. ..... 72/220; 72/88; 72/469

[58] Field of Search ..... 72/88, 90, 469, 192, 72/220; 10/4, 152 R; 153

[56] References Cited

U.S. PATENT DOCUMENTS

| | | | |
|---|---|---|---|
| 2,183,689 | 12/1939 | Olson . | |
| 3,339,389 | 9/1967 | Mosow . | |
| 3,405,545 | 10/1968 | Orlomoski | 72/469 |
| 3,653,241 | 4/1972 | Orlomoski . | |
| 3,896,656 | 7/1975 | Orlomoski . | |
| 4,136,416 | 1/1979 | Thomas . | |

OTHER PUBLICATIONS

Industrial Fasteners Institute, Standard 109, issued May 3, 1968.

*Primary Examiner*—Lowell A. Larson

*Attorney, Agent, or Firm*—Yount & Tarolli

[57] ABSTRACT

The present invention provides an improved method of forming improved dies for rolling an article, such as a lock thread convolution. The dies are formed by rolling a circular hob along a flank of a thread form ridge on the die. As the hob is rolled along the thread form ridge, teeth on the hob are pressed against the thread form ridge with a constant force to form uniform indentations and/or projections in the thread form ridge. The indentations and/or projections which are formed in the thread form ridge by the hob all have the same configuration since the hob is pressed against the thread form ridge with a force of a constant magnitude as the hob is rolled along the thread form ridge. During the rolling of an external thread convolution on a bolt blank with the improved die, the indentation and/or projections on the thread form ridge shape teeth on the flank of an external thread convolution on the bolt. Since the indentations and/or projections were originally rolled into the thread formed ridges on the die with a circular hob and since the indentations and/or projections on the die roll teeth on a circular bolt blank, the teeth formed on the flank of the external thread convolution have the same configuration as the teeth on the hob.

19 Claims, 13 Drawing Figures

ROLLING DIES AND METHOD OF FORMING THE SAME

BACKGROUND OF THE INVENTION

This invention relates generally to thread rolling dies and the manner in which the dies are formed. More specifically, this invention relates to thread rolling dies which are used to form lock teeth on the flank of an external thread convolution.

Dies have previously been used to roll designs in various types of articles and to roll external thread convolutions having lock teeth or retainer elements. The dies which are used to roll thread convolutions have thread form ridges or ribs with flanks having indentations which are used to roll the lock teeth on the flank of an external thread convolution. Dies for rolling such a thread convolution are disclosed in U.S. Pat. Nos. 4,136,416 and 3,339,389.

Although dies have previously been used to roll external thread convolutions having lock teeth, difficulty has been encountered in making the dies with projections and/or indentations which will form curved locking teeth of a specific desired arcuate configuration on the flank of the external thread convolution. This difficulty has resulted from the transferring of projections and/or indentations formed on a die with a linear motion of a tool to a thread convolution with a rolling motion. The difference between the linear motion used to form the die and the rolling motion used to form the thread distorts the shape of the projections and/or indentations.

It has been suggested that a blade or tool could be pressed against the flank of a thread form ridge of a die to form the projections and/or indentations in the flank of the thread form ridge, for example, see U.S. Pat. No. 3,653,241. However, the use of a blade or tool to stamp projections and/or indentations in the flank of a thread form ridge of a die is difficult since the blade tends to trap material which opposes the forming of the projections and/or indentations. In addition, it is difficult to determine the extent to which the blade is indented into the thread form ridge of the die. This is because a relatively large force must be applied against the blade to simultaneously form a substantial number of indentations in the thread form ridge.

Thread rolling dies are commonly provided with a face having thread form ridges with a dwell section in which the thread form ridges extend parallel to the back of the die. In addition, the face of the die may have a curved or tapered roll off section where the thread form ridges slope toward the back of the die to permit a blank to gradually lose contact with the die without marring the finished product. In order to prevent the indentations and/or projections formed in the flank of an external thread convolution from being marred as the finished bolt rolls off the dies, the indentations and/or projections in thread formed ridges in the roll off section should have the same configuration as indentations and/or projections formed in the dwell section of the thread form ridges.

BRIEF SUMMARY OF THE PRESENT INVENTION

The present invention provides a new and improved die which is formed by a new and improved method. The die has article forming ridges with indentations and/or projections which are formed by rolling a circular hob along the ridges. As the circular hob rolls along a ridge, teeth on a circumferential edge portion of the hob are pressed into the flank or side of the ridge.

In order to form all of the indentations and/or projections in an article forming ridge with the same configuration, the hob is pressed against the ridge with a constant force as the hob is rolled along the ridge. The uniform force used to press the teeth of the hob into the flank or side of the ridge results in the configuration of the indentations and/or projections in the roll off section being the same as the configuration of the indentations and/or projections in the dwell section of the die.

Although the present invention can be used in association with the forming of many different types of articles, it is advantageously used in association with the forming of an external thread convolution. Since the indentations and/or projections are rolled into the thread form ridge by a circular hob and since the projections and/or indentations are rolled into an external thread convolution on a cylindrical bolt blank by the thread form ridge, the projections and/or indentations formed in the thread convolution will have a configuration which is the same as the configuration of the circular array of teeth on the circumferential edge portion of the hob. This enables the lock teeth to be formed on the flank of the external thread convolution with a desired configuration which can be accurately predicted by merely forming the teeth on the hob with the desired configuration.

Accordingly, it is an object of this invention to provide a new and improved method of forming a new and improved die having article forming ridges with indentations and/or projections which are formed by rolling a hob along the ridges.

Another object of this invention is to provide a new and improved method of forming a new and improved die and wherein indentations and/or projections are formed in a an article forming ridge of a die by rolling a circular hob along the ridge and pressing the circular hob against the ridge with a constant force as the hob rolls along the ridge regardless of the die configuration.

Another object of this invention is to provide a new and improved method of forming a new and improved thread rolling die and wherein a series of indentations and/or projections in a flank of a thread form ridge in dwell and roll off sections of the die have the same configuration.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

General

Although the present invention can be used in connection with the forming of many different types of articles, the advantages of the invention are of particular significance in connection with the forming of external thread convolutions. Therefore, the invention will be described in connection with the forming of an external thread convolution.

Figure 3:
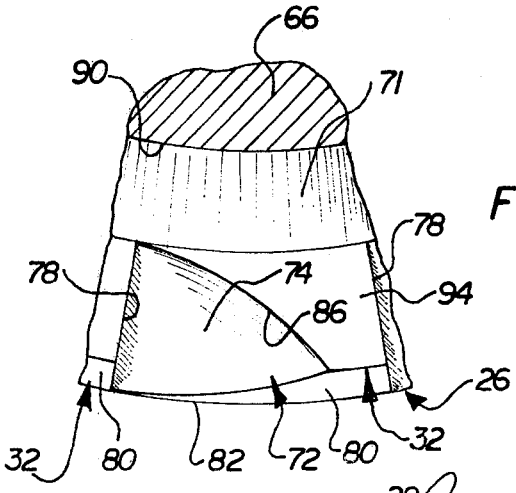
FIG. 3 is an enlarged fragmentary illustration of a lock tooth on the flank of the thread convolution of FIGS. 1 and 2.
Figure 4:
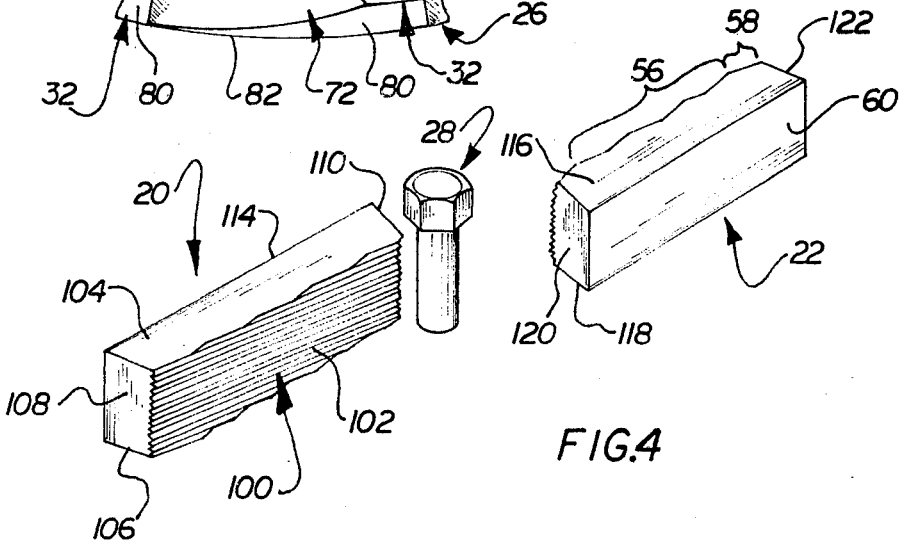
FIG. 4 is a schematic illustration depicting a pair of dies and a blank on which the external thread convolution of FIGS. 1 and 2 is rolled by the dies.

Dies 20 and 22 (FIG. 4) are used to roll an external lock thread convolution 26 (FIGS. 1 and 2) in a bolt blank 28 (FIG. 4). The thread convolution 26 includes a plurality of radially and axially extending lock teeth or retainer elements 32 (see FIGS. 2 and 3) formed on a load bearing flank of the thread convolution. The lock teeth 32 enable a fastener 34, formed from the bolt blank 28 (FIG. 4), to be rotated in a clockwise direction to tightly engage a mating internal thread convolution without gouging or scraping of the mating thread convolution.

Upon the application of a load or vibratory force tending to loosen the fastener 34, the lock teeth 32 engage the mating internal thread convolution to prevent relative rotation between the fastener and the mating thread convolution in a direction tending to loosen the fastener. Thus, the lock teeth or retainer elements 32 do not interfere with tightening of the fastener 34 and are effective to prevent loosening of the fastener. Although the lock teeth or retainer sections 32 could have many different configurations, they are advantageously formed with a configuration which is generally similar to the configuration shown in U.S. patent application Ser. No. 026,879, filed Apr. 4, 1979, by Terry D. Capuano and entitled "Thread Convolution" and assigned U.S. Pat. No. 4,273,175.

In accordance with a feature of the present invention, a circular hob 36 (see FIG. 5) is rolled along conventional thread form ridges or ribs 38 formed in the die 22 to form indentations 40 (FIG. 10) and projections 42 in flank surfaces 44 of the thread form ridges 38. When the cylindrical bolt bank 28 is rolled along the thread form ridges, the rolling action of the hob 36 is reversed. Therefore, the indentations 40 and projections 42 in the thread form ridges 38 of the die 22 form thread convolution lock teeth 32 having the same configuration as teeth 48 (FIG. 5) disposed in a circular array on a circumferential edge portion of the hob 36.

In accordance with another feature of the present invention, the hob 36 is pressed downwardly (as viewed in FIG. 5) against the flanks or sides 44 of the thread form ridges 38 with a substantially constant force as the hob is rolled along the thread form ridges. Thus, as the hob 36 is rotated in the direction indicated by the arrow 50 in FIG. 5, the hob is pressed against the thread form ridges 38 with a substantially constant force indicated by the arrow 52. This results in the formation of a series of indentations 40 (FIG. 10) and projections 42 all having the same configuration. Since the indentations 40 and projections 42 are sequentially formed with a rolling action, only a relatively small and easily controlled force is required to form the indentations and projections.

In accordance with still another feature of the present invention, the hob 36 is used to roll recesses 40 and projections 42 in both a linear dwell section 56 (FIG. 10) and a sloping roll off section 58 of the die 22. In accordance with common practice, the stationary die 22 is provided with a dwell section 56 in which the thread form ridges 38 extend substantially parallel with a back or rear side surface 60 (FIG. 4) of the die. The die 22 is also provided with a roll off section 58 (FIG. 10) in which the thread form ridges 38 slope or taper to the finish end of the die face. The roll off section 58 enables the bolt blank 28 to gradually lose contact with the die 22 without marking the blank.

Since the hob 36 (FIG. 5) is rolled along and pressed against the thread form ridge 38 with a constant force in the dwell section 56 and the roll off section 58, the indentations 40 and projections 42 (FIG. 10) formed in the dwell section are identical to the indentations and projections formed in the roll off section 58. Therefore, when the bolt blank 28 rolls from the dwell section 56 into the roll off section 58, the lock teeth 32 formed on the flank of the bolt thread convolution are not impaired. If the indentations 40 and projections 42 formed in the roll off section 58 were not identical to the indentations and projections in the dwell section 56, there would be interference between the lock teeth 32 previously formed on the thread convolution 26 and the indentations 40 and projections 42 in the roll off section.

External Thread Convolution

The bolt 34 (FIG. 1) has a hexagonal head end portion 64 and an axially extending generally cylindrical shank 66. The external thread convolution 26 is formed on the shank 66. Although a particular known type of externally threaded fastener 34, that is a bolt, has been shown in FIG. 1, it should be understood that the present invention is applicable to other known types of externally threaded fasteners. In fact, the present invention is applicable to articles other than external thread convolutions.

Figure 1:
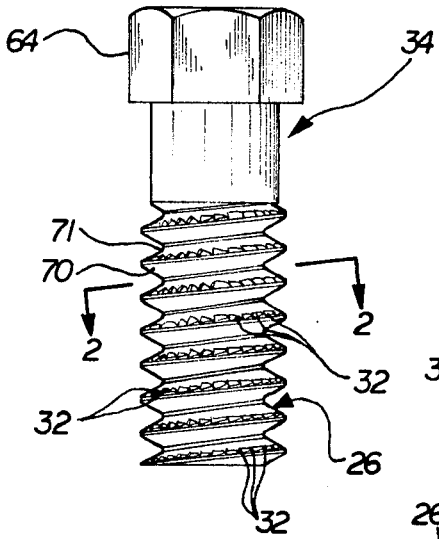
FIG. 1 is an illustration of a fastener having an external thread convolution with lock teeth.
Figure 2:
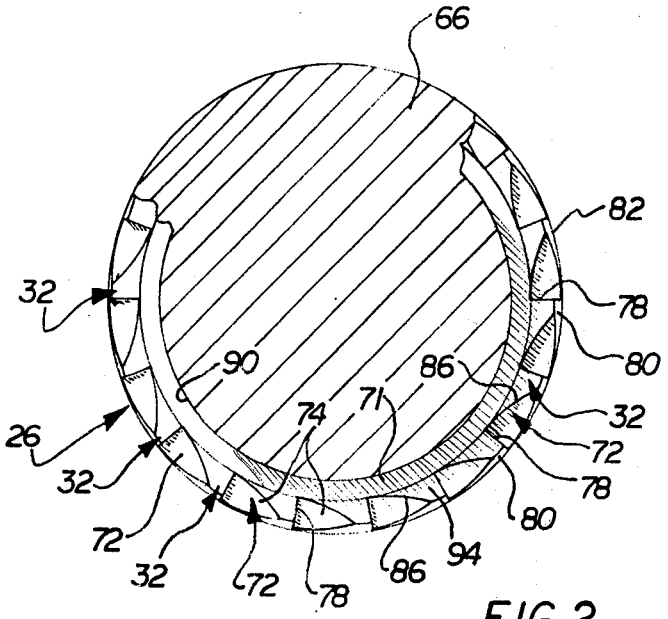
FIG. 2 is a sectional view, taken generally along the line 2—2 of FIG. 1, illustrating a series of lock teeth formed in the flank of the external thread convolution.

The external thread convolution 26 includes a plain or nonload-bearing flank 70 which is the lower flank surface as viewed in FIG. 1. The opposite or load-bearing flank surface 71 is provided with the lock teeth 32. Interspersed between the lock teeth 32 are recesses 72 (FIG. 2). Each of the recesses 72 has a curving bottom surface 74 (FIG. 3) which slopes in a clockwise direction (as viewed in FIG. 2) from a narrow shallow portion of the recess to a relative wide deep portion of the recess.

Each of the retainer elements or lock teeth 32 (FIG. 3) has a sharply defined radially extending edge 78. Each lock tooth edge 78 extends radially and axially outwardly to a sloping side 80 (FIG. 3) which extends inwardly from a helical crest 82 of the thread convolution 26. The deepest end portion of the recess 72 is adjacent to the radially extending edge 78 of the lock tooth 32. This results in the lock tooth 32 extending axially outwardly of the plane of the flank surface 71.

The recess 72 has a continuously curving edge or line of intersection 86 with a flank surface 71 of the thread convolution 26. As the depth of the recess decreases, the edge 86 curves outwardly toward the crest 82 of the thread convolution. The recess 72 extends radially inwardly from the crest 82 of the thread convolution 26 and stops short of the root 90 of the thread convolution.

Each of the identical retainer elements or lock teeth 32 is integrally formed with the flank 71 of the lock thread convolution 26. The lock teeth 32 are resiliently deflectable, to some extent at least. Each lock tooth 32 has a radially inwardly sloping major side surface 94 which slides along the flank of a mating thread convolution when the bolt 34 is turned in a clockwise direction to tighten the engagement between the bolt and the mating thread convolution.

Due to the sloping major side surfaces 94 on the lock teeth 32 and the recesses 72 which taper radially and axially inwardly from the crest of the threaded convolution, the fastener 34 is readily turned into free engagement with a standard internal thread convolution without gouging or marring internal the thread convolution. As the fastener 34 is tightened, the side surfaces 94 of the lock teeth 32 and the bottom surfaces 74 of the recesses 72 merely slide along the flank surface of the internal thread convolution and do not form discontinuities by gouging or digging into the flank of the internal thread convolution.

Once the fastener 34 has been fully tightened, the lock or retainer teeth 32 prevent loosening or counterclockwise rotation between the mating internal thread convolution and the external lock thread convolution 26. To prevent undesired loosening movement between the two thread convolutions, upon initiation of reverse or loosening rotation between the two thread convolutions, the sharply defined radially extending edge portions 78 of the lock teeth 32 dig into the flank surface of the internal thread convolution. This results in a locking action which holds the fastener 34 in place and prevents loosening of the fastener relative to the internal thread convolution.

Accordingly, due to the arcuately curving configuration of the recesses 72 and side surfaces 94 of the lock teeth 32, the fastener 34 can be tightened without gouging or otherwise weakening an internal thread convolution. However, upon the application of forces tending to loosen the fastener, the sharply defined radially extending edges 78 on the lock teeth 32 dig into the internal thread convolution to prevent loosening movement. Since the sharply defined edges 78 extend radially inwardly from the crest 82 of the external thread convolution, the lever arm of the lock teeth 32 to prevent loosening movement of the fastener 34 is maximized. By having the lock teeth or retainer fingers 32 stop short of the root 90 of the external thread convolution 26, the tendency of the recesses 72 to weaken the external thread convolution and cause stress concentrations is minimized. Although the lock teeth 32 could have many different configurations, there are generally the same as shown in U.S. Pat. No. 4,273,175.

Dies

The external thread convolution 26 is rolled onto the bolt blank 28 with the dies 20 and 22 (see FIG. 4). Although the dies 20 and 22 could be of the duplex face type, they are of the single face type. Thus, the movable die 20 includes a die face 100 upon which straight thread form ridges or ribs 102 are disposed. In accordance with common practice, the thread form ridges 102 have a V-shaped cross sectional configuration. However, the thread form ridges 102 could have a configuration other than the V-shaped configuration illustrated in the drawings.

The thread form ridges 102 are disposed between top and bottom sides 104 and 106 of the die 20 and extend between opposite end surfaces 108 and 110. Although the movable die 20 could have a roll off or roll on section if desired, the thread form ridges 102 in the illustrated die 20 extend parallel to a back side 114 of the die. In accordance with common thread forming practice, the straight thread form ridges or ribs 102 extend transversely to the top and bottom sides 104 and 106. However, when the invention is to be used in connection with dies for forming articles other than fasteners having external thread convolutions, the ridges could extend parallel to the top and bottom sides of the die.

The stationary die 22 has top and bottom sides 116 and 118 which extend between opposite ends 120 and 122 of the die 22. The die 22 is initially formed with inverted V-shaped thread form ridges 38 (see FIG. 5) having uninterrupted flat flank or side surfaces 44. Although the roll off section 58 has not been clearly illustrated in FIG. 5, it should be understood that the stationary die 22 is initially formed with conventional V-shaped thread form ridges 38 which extend from the dwell section 56 (FIG. 4) through the roll off section 58 with continuous uninterrupted crest and flank surfaces.

The thread form ridges or ribs are separated by straight grooves 124 (FIG. 5) having a V-shaped cross sectional configuration. The grooves 124 are defined by the flank or side surfaces 44 and extend from the root of the thread form ridges 38 to the crest of the thread form ridges. As initially formed, that is before the hob 36 is rolled along the thread form ridges 38, the stationary die 22 has a conventional construction in accordance with the standards of the International Fasteners Institute, more specifically, in accordance with IFI Standard No. 109 issued May 3, 1968. Of course, the dies 20 and 22 could be initially formed in a different manner if desired. Although the grooves 124 have been illustrated as having a generally V-shaped cross sectional configuration, they could have a different cross sectional configuration.

Hob

Figure 7:
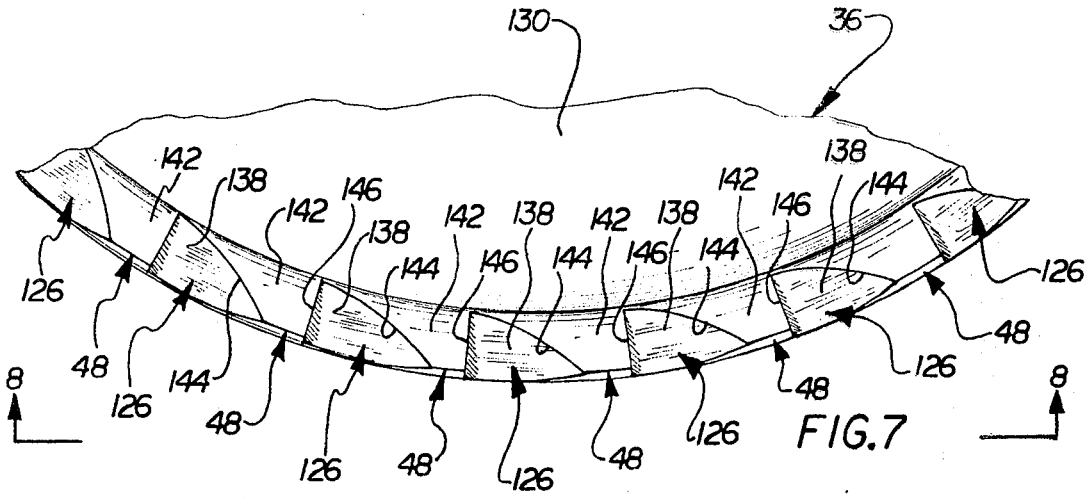
FIG. 7 is an enlarged fragmentary plan view illustrating the configuration of teeth and recesses formed in the circumferential edge portion of the hob of FIG. 5.
Figure 8:
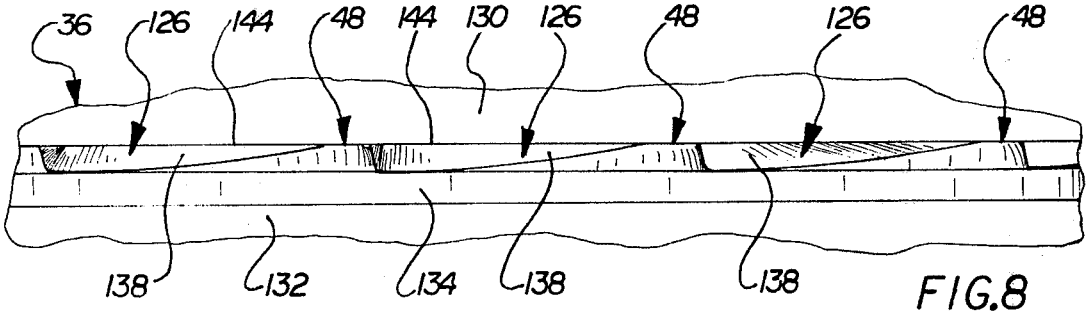
FIG. 8 is an enlarged fragmentary view, taken generally along the line 8—8 of FIG. 7, further illustrating the configuration of the teeth and recesses formed in the circumferential edge portion of the hob.

The hob 36 (see FIG. 5) has a circular configuration with teeth 48 disposed in a circular array about a circumferential edge portion of the hob. Interspersed in the circular array between the hob teeth 48 are recesses 126 (see FIGS. 7 and 8). The hob recesses 126 and teeth 48 have the same configuration as the recesses 72 and lock teeth 32 (see FIGS. 2 and 3) disposed on the external thread convolution 26.

Figure 5:
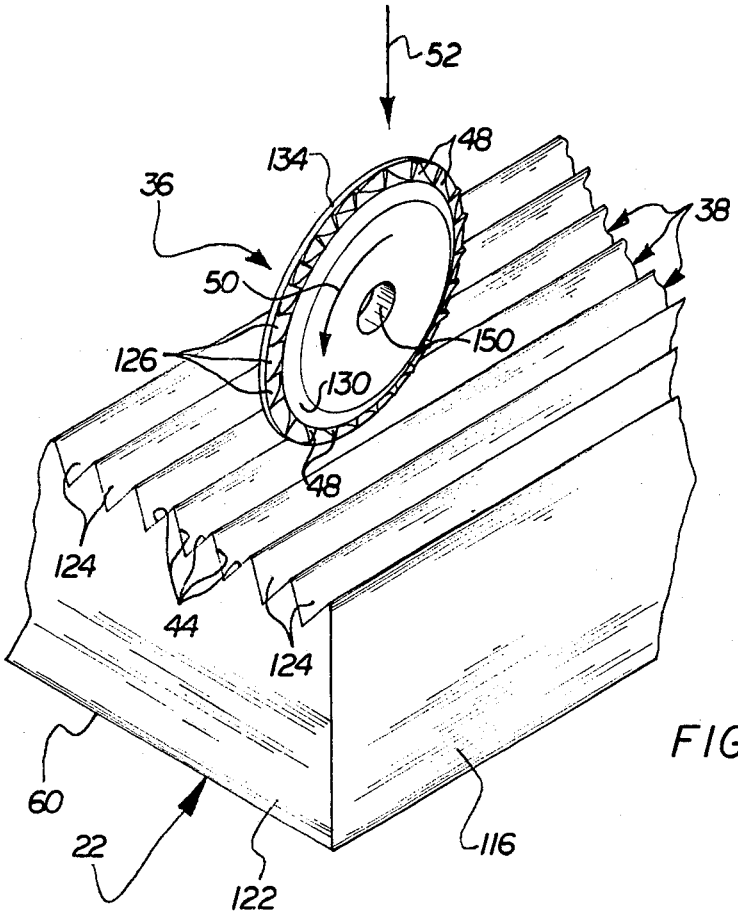
FIG. 5 is a fragmentary schematic illustration of a hob which is used to roll indentations and/or projections in thread form ridges on one of the dies of FIG. 4.
Figure 9:
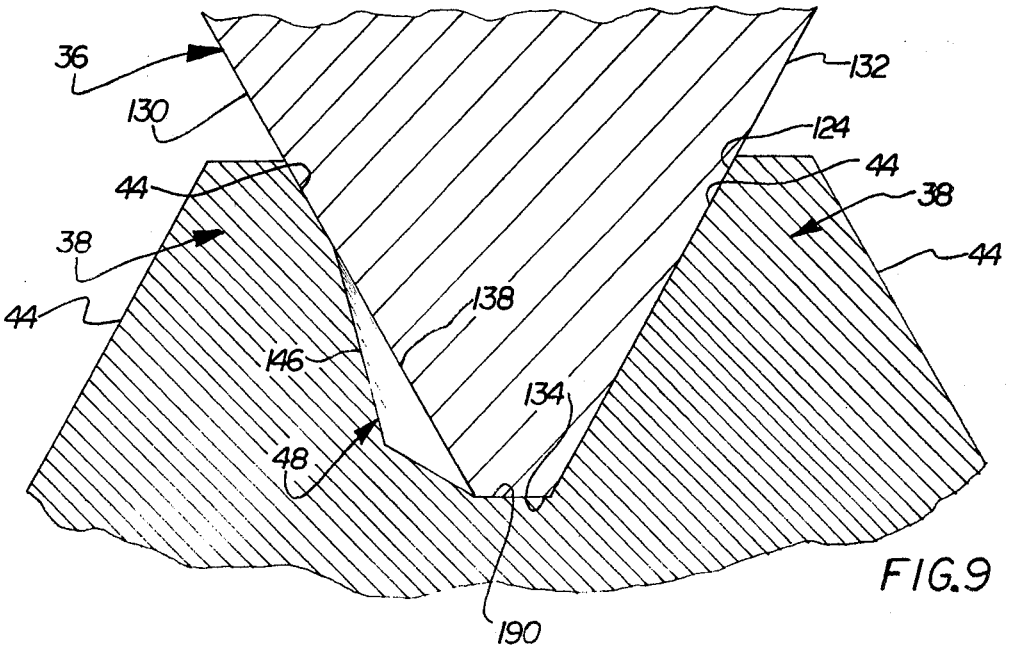
FIG. 9 is an enlarged fragmentary sectional view illustrating the manner in which one of the hob teeth of FIGS. 7 and 8 is pressed into the flank of a thread form ridge on a die of FIGS. 4 and 5.

The hob 36 has a pair of inwardly sloping side surfaces 130 and 132 (FIG. 8) which extend radially outwardly from a central portion of the hob toward a cylindrical rim surface 134 (FIGS. 7 and 8) which extends around the periphery of the hob 36. The side surfaces 130 and 132 have the same included angle as the included angle between the flanks 44 of the thread from ridges 38 (FIGS. 5 and 9). In one specific instance, these included angles were 60°.

The hob recesses 126 have bottom surfaces 138 which have the same configuration as the surfaces 74 (see FIGS. 2 and 3) formed in the external thread convolution 26. Thus, the surfaces 138 of the hob recesses 126 (FIGS. 7 and 8) slope axially inwardly in a clockwise direction (as viewed in FIG. 7) from a relatively shallow narrow end portion to a relatively wide and deep end portion.

The radially and axially projecting hob teeth 48 are provided with arcuately curving major side surfaces 142 (FIG. 7) which extend from an arcuately curving edge 144 or intersection with the recess bottom surface 138 to a radially extending sharp edge 146 on the hob teeth 48. The arcuately curving edge or line of intersection 144 between the recess 138 and hob tooth 48 corresponds to the arcuately curving line of intersection 86 (see FIG. 3) between the recess 72 and the locking tooth or retainer section 32 of the external thread convolution. Similarly, the sharp radially extending edge 146 (FIG. 7) on the hob tooth 48 corresponds to the sharp radially extending edge 78 (FIG. 3) on the lock tooth 32 of the external thread convolution.

The hob 36 has a circular and central opening 150 (FIG. 5) in which an axle 152 (FIG. 6) supports the hob for rotation relative to a mounting bar 154. The mounting bar 154 has a cylindrical configuration and is disposed in a cylindrical opening 158 formed in a ram 160. A set screw 162 extends into a slot 164 formed in the mounting bar 154 to limit the extent of axial movement of the mounting bar and to hold the mounting bar against rotation about its central axis.

In order to provide a clear indication of the amount of force being applied by the hob 36 against a thread form ridge 38 on the die 22, an indicating means, such as a load cell or washer 170 (FIG. 6), is provided between a surface 172 connected with the ram 160 and an annular flange 174 which is fixedly connected with the mounting bar 154. The load cell 170 has an output which is transmitted through a lead 178 to a display module 180. The display module 180 has a window 182 at which can be read the load force applied to the hob 36, that is the force represented by the arrow 52 of FIG. 5.

Although the load cell 170 and digital display module 180 could have many different constructions, in one specific embodiment of the invention, the load cell was a Thor Power Tool Company tension transducer Module No. 12054C. The digital display unit was obtained from the Thor Power Tool Company and was manufactured by Stewart Warner Company and was referred to as model No. 12381A by the Thor Power Tool Company. Of course, other load cells and digital display modules having a different construction could be used if desired and the foregoing specific models of the load cells and display modules have been set forth herein for purposes of clarity of illustration and not for purposes of limitation.

Although it is preferred to use a load cell or washer 170 as the load indicating means, other known types of load indicators could be used if desired. In fact the load indicator could be omitted and a hydraulic or pneumatic device could be used to maintain the load constant.

Rolling Indentations and Projections in the Thread Form Ridges

In order to form the indentations in the thread form ridges 38 of the die 22 (FIG. 5), the hob 36 is rolled along the thread form ridges for a distance which is greater than one turn of the external thread convolution 26. If the lock teeth 32 are to be formed on each turn of the external thread convolution 26, in the manner shown in FIG. 1, each of the thread form ridges 38 will be rolled with the hob 36. Of course, if some of the turns of the external thread convolution 26 are not to be formed with locking teeth 32. Some of the thread form ridges 38 would not be rolled with the hob 36.

Figure 6:
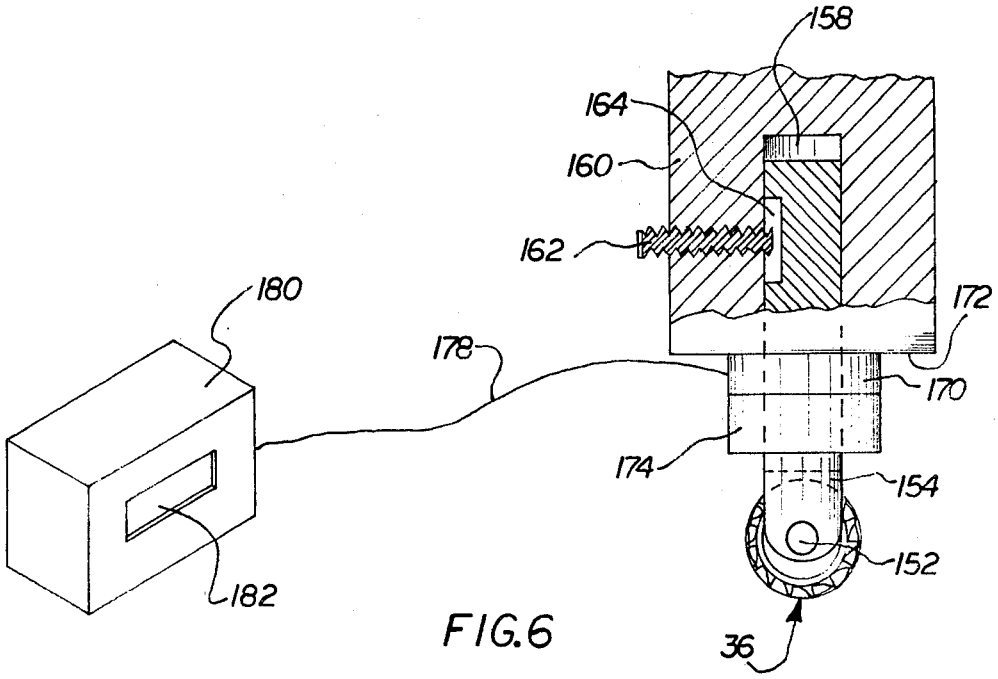
FIG. 6 is a schematic illustration depicting the manner of measuring the force which presses the hob against the thread form ridges of the die of FIG. 5.

In order to roll the indentations 40 and projections 42 (FIG. 10) into a flat flank surface 44 of a thread form ridge 38, the hob 36 is positioned with the side surface 132 of the hob in abutting engagement with a flat flank surface 44 of an adjacent thread form ridge (see FIG. 9). The hob 36 is then pressed downwardly with the forse 52 (FIG. 5) by the ram 160 (FIG. 6). As this occurs, the hob teeth 48 are impressed into the flat flank 44 of a thread form ridge 38. Downward motion of the hob 36 stops when the force applied against the hob by the ram 160 reaches a selected value. Since the lock teeth 32 (FIGS. 1 and 2) extend to the crest of the thread convolution 26, the annular outer surface 134 of the hob 36 is very close to or abuts the root or bottom 190 of the groove between the thread form ridges (FIG. 9) when the force applied against the ram reaches the selected value.

The hob 36 is then rolled along a groove 124 between a pair of thread form ridges 38 and pressed into the groove with a constant force indicated by the digital display module 180. As the hob rolls along a groove 124 between the thread form ridges 38, the cylindrical outer side surface 134 of the hob rolls along the root surfaces 190 (FIG. 9) between the thread form ridges 38. This limits the extent to which the hob 36 indents the thread form ridge 38. The side surface 132 of the hob engages the flank surface 44 of the thread form ridge adjacent the one in which the indentations 40 and projections 42 (FIG. 10) are being formed by the hob teeth 48.

As the hob 36 is rolled along the dwell portion 56 (FIG. 4) of a thread form ridge, the hob is moved along a straight path which extends parallel to the back side 60 of the die 22. However, when the hob rolls into the roll off section 58 of the thread form ridge, the path of movement of the hob slopes toward the rear surface 60 of the die.

The hob 36 (FIGS. 5 and 6) is continuously pressed into the groove between the thread form ridges 38 with a constant force which is indicated by the display module 180. Therefore, the indentations 40 and projections 42 (FIG. 10) formed in the roll off section 58 of the thread form ridge 38 have the same configuration as the indentations and projections formed in the dwell section 56 of the thread form ridge 38. The force with which the hob 36 is pressed against the thread form ridges 38 is relatively small since the indentations and projections 40 and 42 are being sequentially formed in the thread form ridges. This enables the size and configuration of the indentations and projections 40 and 42 to be accurately controlled.

As the hob 36 rolls into the roll off section 58 of the thread form ridge, the ram 160 (see FIG. 6) is moved toward the die 22 (FIG. 5). This maintains the force with which the hob is pressed against the thread form ridge substantially constant as the path of movement of the hob changes. Once the indentations 40 and projections 42 have been rolled into the thread form ridge 38, the die 22 is heat treated to enhance the operating life of the die.

Since the circular hob 36 rolls along the straight thread form ridges 38, the indentations 40 and projections 42 formed in the flank 44 of a thread form ridge 38 do not have exactly the same configuration as the teeth 48 and recesses 126 (see FIGS. 7 and 8) of the hob 36. Thus, the indentations 40 (FIG. 10) will have a configuration which is generally similar to a negative image of the teeth 48 on the hob 36. The projections 42 will have a configuration which is generally similar to a negative image of the recess 126 in the hob. However, the configuration of the indentation 40 will be slightly different than the configuration of the a hob tooth 48 and the configuration of a projection 42 will be slightly different than the configuration of a hob recess 126. This difference between the positive image of the hob teeth 48 and recesses 126 and the negative image of the thread form ridge recess 40 and projections 42 results from the rolling action of the hob as the recesses 40 and projections 42 are formed in the thread form ridge 38.

The rolling action between the hob 36 and the thread form ridge 38 results in the straight radially extending edge 146 (FIG. 7) at one end of the hob tooth 48 forming a slightly curved edge or line of intersection 200 (FIG. 10) between the indentation 40 and projection 42. In addition, the arc of curvature of the edge 144 (FIG. 7) between the surface 138 of the hob tooth recess 126 and a major side surface 142 of a hob tooth 48 is decreased. This results in a somewhat straighter line of intersection 202 between the projection 42 (FIG. 10) on the thread form ridge 38 and the indentations 40 in the thread form ridge.

Although the thread form ridge indentations 40 and recesses 42 are not exact negative images of the hob teeth 48 and recesses 126, the lock teeth 32 and recesses 72 (FIG. 3) formed in a thread convolution 26 have substantially the same configuration as the teeth 48 and recesses 126 in the hob 36. This is because the bolt blank 28 is rolled along the thread form ridge 38 so that the same rolling action which is present during forming of the indentations 40 and projections 42 in the thread form ridge 38 occurs when the teeth 32 and recesses 72 are formed in the external thread convolution 26 on the bolt blank 28. Although the teeth 32 and recesses 72 on the thread convolution 26 have almost exactly the same configuration as the hob teeth 48 and recesses 126, it should be understood that due to the fact that the bolt blank has a shank that may be of a smaller diameter than the diameter of the hob 36, there may be very slight differences between the configurations of the locking teeth 32 and recesses 72 in the thread convolution 26 and the teeth 48 and recesses 126 in the hob.

Figure 10:
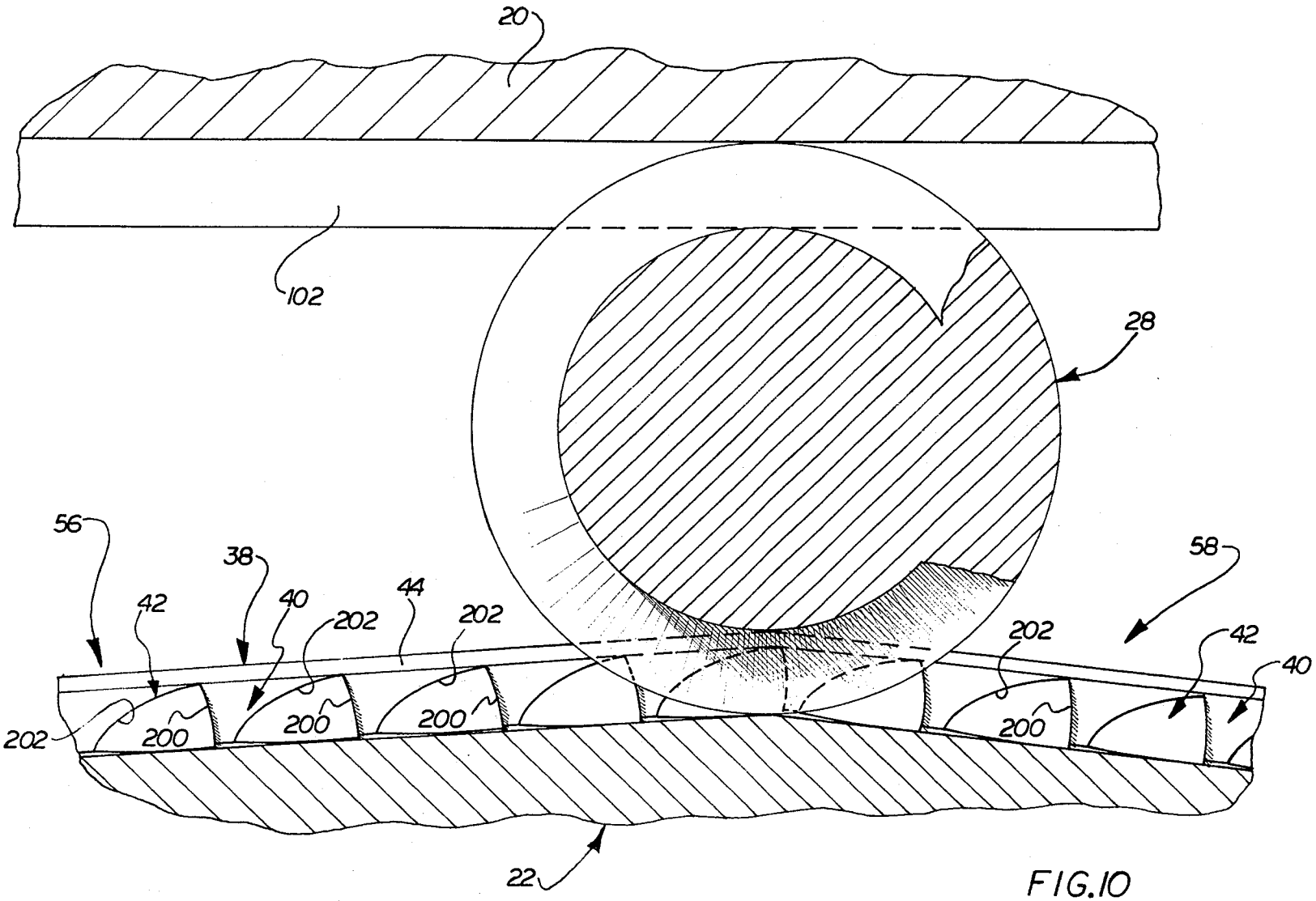
FIG. 10 is an enlarged fragmentary sectional view illustrating the manner in which the dies of FIG. 4 are used to roll locking teeth in the flank of an external thread convolution.

Although the indentations 140 and projections 42 have been shown in FIG. 10 as being rolled into the stationary die 22 by the hob 36, it is contemplated that the thread form ridges 102 of the movable die 20 could be provided with similar indentations and recesses if desired. Of course, if this was done the relationship between the movable and stationary dies 20 and 22 would have to be coordinated so that the indentations 40 and projections 42 formed in the thread form ridge 102 of the movable die would be aligned with the teeth 32 and recesses 72 formed in the external thread convolution by the stationary die. It is also contemplated that although it is preferred to roll the indentations 40 and projections 42 into a V-shaped thread form ridge 38 on a standard die 22, the hob 36 could be used to form the indentations 40 and projections 42 in thread form ridges on an insert which would be mounted in a suitable recess in a die.

Second Embodiment of the Invention

In the embodiment of the invention illustrated in FIGS. 1–10, the bolt 34 has a cylindrical shank and the dwell portions of the thread form ridges 38 and 102 extend parallel to the back side surfaces 60 and 114 of the die. However, it is contemplated that the present invention could be used in association with a fastener having a tapered shank, as for example, a self-threading fastener. Thus, in the embodiment of the invention shown in FIGS. 11 and 12, a fastener 220 (FIG. 11) has an axially tapered shank 222 on which an external thread convolution 224 is rolled. Tapping teeth 226 on the thread convolution 224 have the same configuration as the locking teeth 32 of FIGS. 2 and 3. The tapping teeth 226 are disposed on opposite flanks of a plurality of turns of the thread convolution 224.

The fastener 220 is made from an axially tapered fastener blank 228 (FIG. 12) with a die 230 having a first group 232 of thread form ridges 234 with roots and crests which are disposed in a pair of parallel planes which extend parallel to a rear side surface of the die 230. A second group 238 of thread form ridges 234 are formed on a portion of the die blank which slopes outwardly away from the rear surface of the blank. This portion of the die blank rolls the thread into the tapered portion of the fastener blank 228. The thread form ridges 234 on the sloping portion 238 of the die 230 have crests and roots which are disposed in a pair of parallel planes which extend tranversely to a rear side surface of the die. The dies which are used to roll the blank 228 have a general configuration which is similar to the configuration shown in U.S. Pat. No. 3,896,656.

The previously described method of forming indentations and projections in thread form ridges with the hob 36 can be readily applied to the group 238 of thread form ridges 234 even though they slope relative to the group 232 thread form ridges on the die 230. Thus, the hob 36 can be rolled along the thread form ridges 234 of the group 238 to form indentations and projections of the same configuration as the indentations 40 and projections 42 (FIG. 10) on the thread form ridge 38. Since the force with which the hob is pressed against the thread form ridges 234 of the group 238 is the same as the force with which the hob is pressed against the thread form ridges 234 of the group 232, the indentations 40 and projections 42 formed in the thread form ridges 234 have all the same configuration.

Third Embodiment of the Invention

In the embodiment of the invention illustrated in FIGS. 1–10, the hob 36 is pressed against the flank or side surface 44 of a thread form ridge 38 under the influence of a downward (as viewed in FIGS. 5 and 9) force. This downward force extends perpendicular to a plane containing the crests of a pair of adjacent thread form ridges (see FIG. 9). In the embodiment of the invention shown in FIG. 13, the hob is pressed against the flank surface of a first thread form ridge under the influence of a force which extends parallel to the flank surface of an adjacent thread form ridge. This tends to maximize the force component which is effective to press a hob tooth against a thread form ridge.

Figure 13:
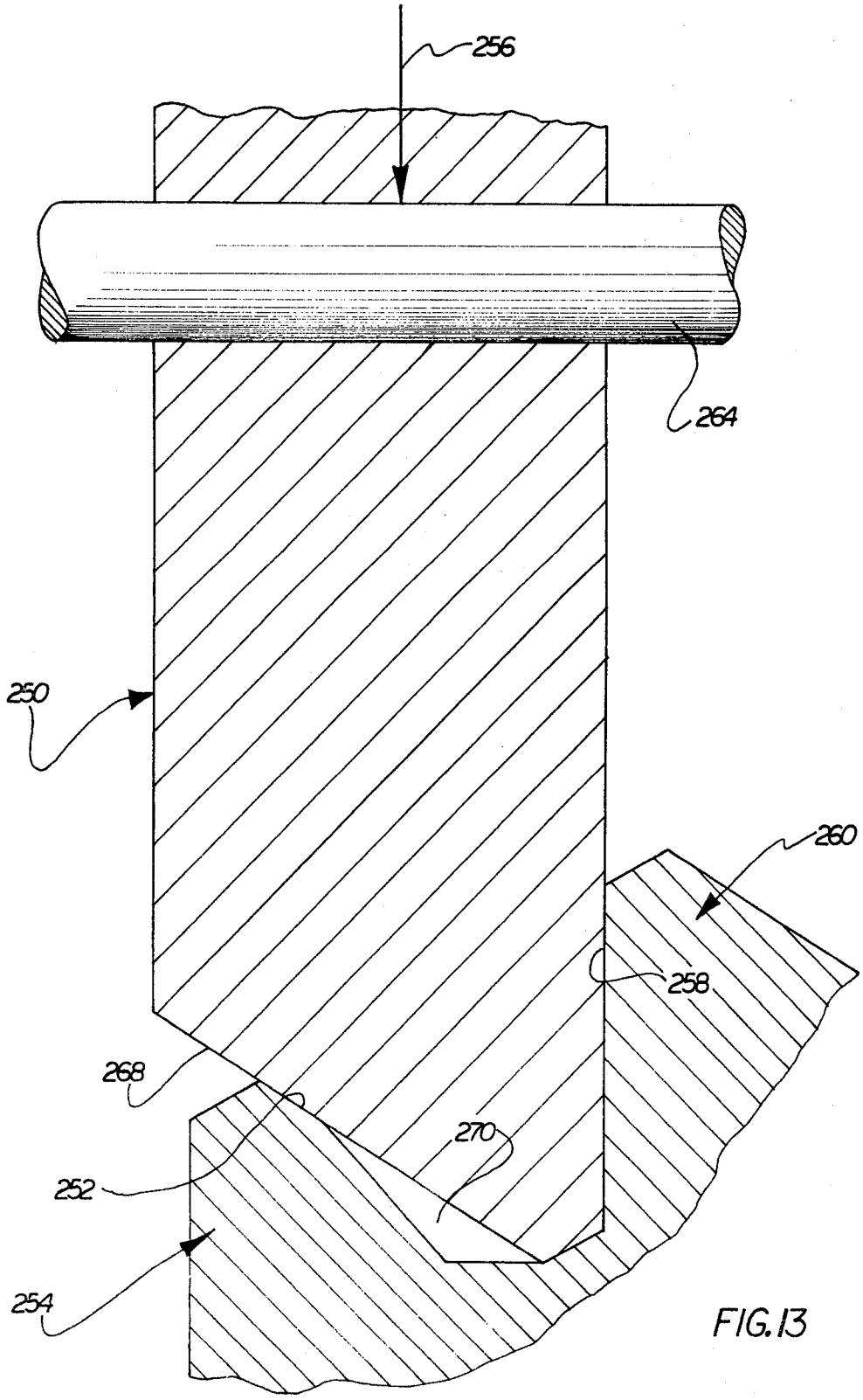
FIG. 13 is an illustration of another embodiment of the invention in which the hob is pressed against a flank or side surface of a thread form ridge with a force extending parallel to a flank surface of an adjacent thread form ridge.

In the embodiment of the invention shown in FIG. 13, a circular hob 250 is pressed downwardly against a flank surface 252 of a thread form ridge 254 under the influence of a force 256 which extends parallel to a flank or side surface 258 of an adjacent thread form ridge 260. Thus, the hob 250 is mounted for rotation on an axle 264 which is connected with a suitable ram in much the same manner as in which the hob 36 is connected with the axle 152 and ram 160 (see FIG. 6). The axle 264 has a central axis which extends perpendicular to the plane of the side surface 258 of the thread form ridge 260.

A downward force 256 applied by the ram against the axle 264 extends parallel to the side surface 258 of the thread form ridge 260. A hob tooth 270 extends outwardly from a conical side 268 of the hob. The teeth and adjacent recesses form indentations and projections in the flank of the thread form ridge 254 in the same manner as in which the hob teeth 48 form the indentations 40 and projections 42 (see FIG. 10) in the thread form ridge 38.

By pressing the hob 250 against the thread form ridge 254 under the influence of a force 256 which extends parallel to the flank or side surface 258 of the adjacent thread form ridge 260, the force component tending to press the hob tooth 270 into the thread form ridge 254 is maximized to thereby tend to minimize the force 256 which must be applied against the hob 250 in order to indent the thread form 254 as the hob 250 is rolled along the thread form ridge. As the hob 250 is rolled along the flank or side surface 252 of the thread form ridge 254, the force 256 is maintained substantially constant to form uniform indentations and projections in the thread from ridge 254.

Summary

The present invention provides a new and improved die 22 which is formed by a new and improved method. The die 22 has article forming ridges or ribs 38 with indentations 40 and/or projections 42 which are formed by rolling a circular hob 36 along the form ridges. As the circular hob 36 rolls along a form ridge 38, teeth 48 on a circumferential edge portion of the hob 36 are pressed into the flank or side 44 of the form ridge.

In order to form all of the indentations 40 and/or projections 42 in the form ridge 38 with the same configuration, the hob 36 is pressed against the form ridge with a constant force as the hob is rolled along the form ridge. The uniform force used to press the teeth 48 of the hob into the flank 44 of the form ridge results in the configuration of the indentations 40 and/or projections 42 in the roll off section 58 being the same as the configuration of the indentations 40 and/or projections 42 in the dwell section 56 of the die.

Although the present invention can be used in association with the forming of many different articles, it is advantageously used in association with the forming of the external thread convolution 26. Since the indentations 40 and/or projections 42 are rolled into the form ridge 38 by a circular hob 36 and since the projections 32 and/or indentations 72 are rolled into the external thread convolution 26 by the thread form ridge 38, the projections and/or indentations formed in the thread convolution will have a configuration which is the same as the configuration of the circular array of teeth 48 on the circumferential edge portion of the hob. This enables the lock teeth 32 to be formed on the flank 71 of the external thread convolution 26 with a desired configuration which can be accurately predicted by merely forming the teeth 48 on the hob 36 with the same configuration.

Figure 11:
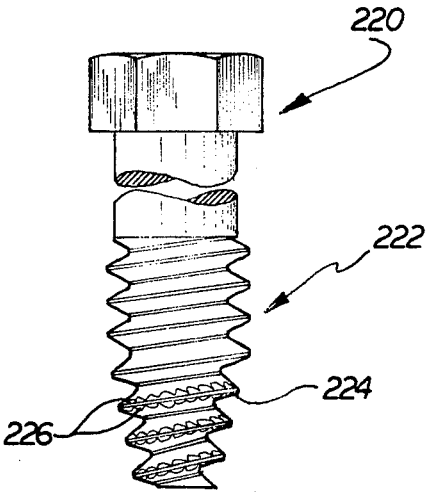
FIG. 11 is an illustration of a second embodiment of a fastener having an external thread convolution with locking teeth on opposite flanks of a plurality of turns of the thread convolution.
Figure 12:
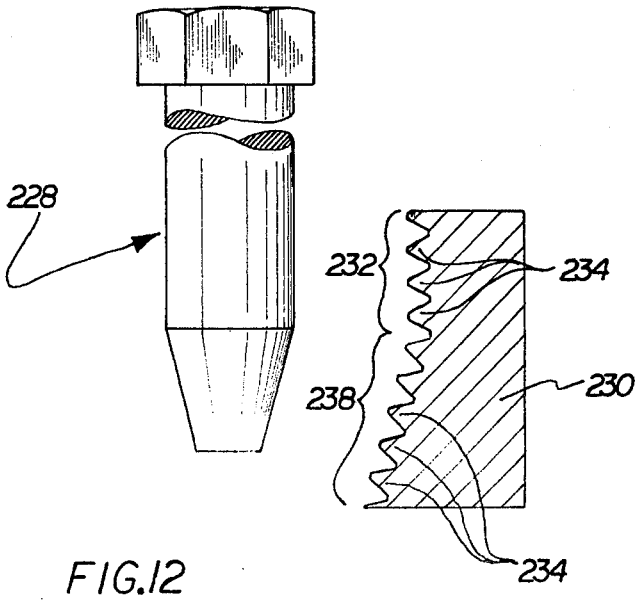
FIG. 12 is a fragmentary schematic illustration of the relationship between a blank and a die which rolls an external thread convolution on the blank to form the fastener of FIG. 11.

Although the projections 32 and/or indentations 72 have been illustrated in FIGS. 1–3 as being formed in only one flank of a thread convolution, it is contemplated that the projections and/or indentations could be formed in both flanks of the thread convolution as shown in FIG. 11. It is also contemplated that the projections 32 and/or indentations 72 could have a configuration other than the specific configuration illustrated herein. For example, the projections and/or indentations could have a configuration similar to that shown in U.S. Pat. No. 4,259,889. Of course, the hob 36 and die ridges or ribs 38 would also have projections and/or indentations with configurations which differ from the configuration illustrated herein.

Having described specific preferred embodiments of the invention, the following is claimed:

1. A method comprising the steps of providing a thread rolling die having a plurality of longitudinally extending thread form ridges with each of the thread form ridges having a crest portion and a pair of flank surfaces extending between the crest portion and root portions disposed on opposite sides of the thread form ridge, providing a circular hob having an annular forming section with projections thereon and a first smooth annular side surface area disposed radially inwardly of the forming section, and forming indentations in one of the flank surfaces of one of the thread form ridges at locations spaced from the crest portion of the one thread form ridge by rolling the circular hob along the one flank surface of the one thread form ridge while leaving the crest portion of the one thread form ridge free of indentations, said step of forming indentations in the one thread form ridge by rolling the circular hob along the one thread form ridge including pressing the projections on the annular forming section of the hob into a portion of the one flank surface adjacent to a root portion of the one thread form ridge and sliding the first smooth annular side surface area of the hob on a portion of the one flank surface adjacent to the crest portion of the one thread form ridge.

2. A method as set forth in claim 1 wherein the circular hob has a second smooth annular side surface area disposed on a side of the hob opposite from the first smooth annular side surface area, said step of forming indentations in the one thread form ridge including the step of sliding the second smooth annular side surface area of the hob on a flank surface of a second thread form ridge adjacent to the one thread form ridge while leaving the crest portion of the second thread form ridge free of indentations.

3. A method as set forth in claim 1 wherein said step of forming indentations in the one thread form ridge includes the step of pressing the periphery of the circular hob against one root portion of the one thread form ridge adjacent to the one flank surface and rolling the circular hob along the one root portion.

4. A method as set forth in claim 1 wherein said step of pressing projections on the annular forming section of the hob into a portion of the one flank surface includes pressing a projection on the forming section of the hob into the one flank surface at a line of intersection of the one flank surface with a root portion of the one thread form ridge.

5. A method as set forth in claim 1 wherein said step of sliding the first smooth annular side surface area of the hob on the one flank surface includes maintaining the first smooth annular side surface area of the hob in continuous abutting engagement with the one flank surface as the hob rolls along the one flank surface.

6. A method as set forth in claim 1 wherein said step of pressing projections on the annular forming section of the hob into a portion of the one flank surface includes applying a force to the hob in a direction extending parallel to a flank surface of a thread forming ridge adjacent to the one thread form ridge.

7. A method as set forth in claim 1 wherein said step of providing a thread rolling die includes the step of providing a die portion in which the thread form ridges have a dwell section and a roll-off section which extends transversely to the dwell section, said step of forming indentations by rolling the circular hob including rolling the hob along the dwell and roll-off sections while performing said step of pressing the projections on the annular forming section into a portion of the one flank surface.

8. A method comprising the steps of providing a thread rolling die having a plurality of longitudinally extending thread form ridges with each of the thread form ridges having a crest portion and a pair of flank surfaces extending between the crest portion and root portions disposed on opposite sides of the thread form ridge, providing a hob having a circular rim with first and second sides extending radially outwardly from a central portion of the hob to the rim, pressing the first side of the hob against a flank surface on a first one of the thread form ridges at a location disposed radially inwardly from the rim of the hob, pressing the second side of the hob against a flank surface on a second thread form ridge at a location disposed radially inwardly from the rim of the hob while performing said step of pressing the first side of the hob against the flank surface on the first thread form ridge, and rolling the circular hob along the first and second thread form ridges with the circular rim of the hob between the first and second thread form ridges and while continuing to perform said steps of pressing the first and second sides of the hob against flank surfaces on the first and second thread form ridges, said step of rolling the circular hob along the first and second thread form ridges including forming indentations in the flank surface of the first thread form ridges with projections on the first side of the hob while performing said step of rolling the hob along the first and second thread form ridges.

9. A method as set forth in claim 8 further including the step of pressing the circular rim of the hob against a root portion disposed between the first and second thread form ridges while performing said step of rolling the circular hob along their first and second thread form ridges.

10. A method as set forth in claim 8 wherein said step of forming indentations in the flank surface of the first thread form ridge includes the step of pressing a projection on the first side of the circular hob against the flank surface of the first thread form ridge at a location spaced from the crest portion of the first thread form ridge.

11. A method as set forth in claim 8 wherein said step of rolling the circular hob along the first and second thread form ridges includes sliding the second side of the hob along the flank surface of the second thread form ridge without forming indentations in the flank surface of the second thread form ridge while performing said step of forming indentations in the flank surface of the first thread form ridge.

12. A method as set forth in claim 8 wherein said step of forming indentations in the flank surface of the first thread form ridge with projections on the first side of the circular hob includes moving a projection on the first side of the circular hob past the crest portion of the first thread form ridge into engagement with the flank surface of the first thread form ridge without engaging the crest portion of the first thread form ridge with the projection.

13. A method as set forth in claim 8 wherein said step of providing a thread rolling die includes the step of providing a die portion in which the thread form ridges have a dwell section and a roll off section which extends transversely to the dwell section, said step of forming indentations in the flank surface of the first thread form ridge includes the step of forming indentations in the flank surface of the first thread form ridge in both the dwell and roll-off sections.

14. A method as set forth in claim 8 wherein said step of pressing the second side of the hob against a flank surface on the second thread form ridge is performed with the flank surface on the second thread form ridge disposed in a plane extending perpendicular to an axis about which the circular hob is rotated during said step of rolling the circular hob along the first and second thread form ridges and with the flank surfaces on the first thread form ridge disposed in a plane extending transversely to an axis about which the circular hob is rotated.

15. A thread rolling die comprising a plurality of longitudinally extending thread form ridges, each of the thread form ridges including a crest portion and a pair of flank surfaces extending between the crest portion and root portions disposed on opposite sides of each of the thread form ridges, and a plurality of indentations formed in one of the flank surfaces of one of the thread form ridges, each of said indentations extending from a location on the one flank surface spaced from the crest portion of the one thread form ridge to a root portion on the one thread form ridge, said crest portions of each of said thread form ridges being free of indentations, each of said indentations being formed by a process which includes the steps of rolling a circular hob along the one flank surface of the one thread form ridge while leaving the crest portion of the one thread form ridge free of indentations, said step of rolling the circular hob along the one flank surface of the one thread form ridge including pressing projections on the hob into a portion of the one flank surface adjacent to a root portion of the one thread form ridge and sliding a smooth annular side surface area of the hob on a portion of the one flank surface adjacent to the crest portion of the one thread form ridge.

16. A thread rolling die as set forth in claim 15 wherein said step of rolling the circular hob along the one flank surface of the one thread form ridge includes the step of sliding a second smooth annular side surface of the hob on a flank surface of a second thread form ridge adjacent to the one thread form ridge while leaving the crest portion of the second thread form ridge free of indentations.

17. A thread rolling die as set forth in claim 15 wherein said step of rolling the circular hob along the one flank surface of the one thread form ridge includes the step of pressing the periphery of the circular hob against one root portion of the one thread form ridge adjacent to the one flank surface and rolling the circular hob along the one root portion.

18. A thread rolling die comprising a plurality of longitudinally extending thread form ridges, each said thread form ridge including a crest portion and a pair of flank surfaces extending between the crest portion and root portions disposed on opposite sides of each of the thread form ridges, and a plurality of indentations formed in one of the flank surfaces of one of the thread form ridges at locations spaced from the crest portion of the one thread form ridge, said indentations being formed by a process which includes pressing a first side of a hob against a flank surface on a first one of the thread form ridges, pressing a second side of the hob against a flank surface on a second thread form ridge while performing said step of pressing the first side of the hob against the flank surface on the first thread form ridge, and rolling the circular hob along the first and second thread form ridges while continuing to perform said step of pressing the first and second sides of the hob against flank surfaces on the first and second thread form ridges, said step of rolling the circular hob along the first and second thread form ridges while pressing the first and second sides of the hob against the flank surfaces on the first and second thread form ridges including the step of sequentially pressing each projection in a series of projections disposed on the first side of the hob into the flank surface of the first thread form ridge at locations spaced from the crest portion of the first thread form ridge.

19. A thread rolling die as set forth in claim 18 wherein said process further includes the step of pressing the circular rim of the hob against a root portion disposed between the first and second thread form ridges while performing said step of rolling the circular hob along the first and second thread form ridges.

* * * * *